United States Patent [19]

Peterson et al.

[11] 3,947,215

[45] Mar. 30, 1976

[54] FUME FLARE

[75] Inventors: Richard W. Peterson; L. Graydon Carpenter; Raymond Kastelic, all of Lower Burrell, Pa.

[73] Assignee: Aluminum Company of America, Pittsburgh, Pa.

[22] Filed: Jan. 7, 1975

[21] Appl. No.: 539,242

[52] U.S. Cl. ..... 431/5; 23/277 C; 431/202

[51] Int. Cl.[2] ..... F23G 7/06

[58] Field of Search ..... 431/5, 202, 353; 23/277 C

[56] References Cited

UNITED STATES PATENTS

| | | | |
|---|---|---|---|
| 3,073,684 | 1/1963 | Williams | 23/277 C |
| 3,106,955 | 10/1963 | Flasskamp et al. | 431/5 |

*Primary Examiner*—Edward G. Favors

*Attorney, Agent, or Firm*—Jackson, Jackson & Chovanes

[57] ABSTRACT

The method of burning fume, including combustible gases and gas-borne particles, comprising moving the fume in a tube having a blind end and one or more slits in the tube short of the end, while the fume is at least partially at ignition temperature, and emitting the fume into the air, the slit width and the slit total area being chosen such that the fume velocity through the slits will be more than the flame velocity and up to the flame blow-out velocity. The device includes a tube having a closed end and slits having a width between one-eighth and 1 inch and preferably about five-eighths inch, and a length of between one-eighth and one-half of the circumference.

7 Claims, 2 Drawing Figures

FUME FLARE

DISCLOSURE OF INVENTION

Our invention relates to a process and apparatus for burning fume having combustible gases and combustible particles, the fume being moved in a tube having a blind end and having at least one slit, the fume when released in the air being at least partially at ignition temperature, the slit width and slit total area being chosen such that the fume velocity through the slits is more than the flame velocity and up to the flame blow-out velocity, with the fume being burned before it is quenched by the air to below ignition temperature. Also, the invention relates to fume flares in which the fume is burned in a tube having closed end and having at least one slit of a width of one-eighth to 1 inch, and preferably of ⅝-inch width.

PRIOR ART

The invention relates to methods and devices for burning fume which results particularly from baking the carbonaceous linings which are formed in the vessel used for electrolytic reduction of aluminum to aluminum metal by the Hall-Heroult process. This carbonaceous lining is baked to harden it and increase its electrical conductivity. Heat is supplied by flames or by electric resistance heating which results is producing fume which exits from the vessel.

Klemm U.S. Pat. No. 2,891,297, granted June 23, 1959, relates to an electrolytic vessel for reduction of aluminum ore.

FIG. 1 shows such a vessel which has a carbonaceous lining 20 and carbonaceous particles 22 protecting the lining. An electrical connection is made by collector rods 24 in the lining.

The lining is surmounted by refractory shell 26 and burners 28 are used in connection with the baking of the lining. As an alternate to the burners, electrical resistors (not shown) may be used. Fume is produced by the baking of the lining and goes out through stack 30. The fume contains combustible gases and also entrained solid particles of carbonaceous material.

An incinerator has an annular escape vent in Brophy U.S. Pat. No. 3,357,375, granted Dec. 12, 1967. Another expedient is shown in Stockman U.S. Pat. No. 3,572,265, granted Mar. 23, 1971, in which a stack is provided and flame is introduced into this stack to burn with aspirated air.

Lausmann U.S. Pat. No. 3,638,591, granted Feb. 1, 1972, uses a cone which is surmounted by a cylinder provided with louvres in the side. Spitz U.S. Pat. No. 3,076,421, granted Feb. 5, 1963, shows a cone topped by a cylinder having a lateral aperture.

Audels Home Gas Heating and Appliance Manual by Edwin P. Anderson, Theodore Audel & Co., January 1965, has an incinerator which has a ventilation screen at the outside and a closed end.

THE PRESENT INVENTION

The present invention involves a method of burning fume, including combustible gases and gas-borne combustible particles. The fume is moved along a tube which is closed at the end and which has at least one slit on its circumference adjacent the closed upper end. As it moves through the slit or slits, the fume is preferably completely above the temperature at which it will burn.

The fume burns at and around the slits and is evolved in burning condition into the air.

While it is preferred that the fume be completely above the temperature at which it will burn, some regions in it can be permitted to be below that temperature, termed the ignition temperature. Thus, as long as there is enough fume region at or above ignition temperature to maintain burning, operation is successful. It can be determined by simple observation whether the regions below ignition temperature have become too large, because then smoke is caused, this indicating that the fume has not been able to burn completely before being quenched by the air to below ignition temperature.

The slit width is preferably about five-eighths inch, though it may be as little as one-eighth inch or as much as 1 inch.

The fume velocity as it goes through the slits is such that the fume velocity may be anywhere from the flame velocity up to the flame blow-out velocity. Toward the feature of having the fume burned before it is quenched by the air to below ignition temperature, it is preferred that the fume velocity through the slits not be above 5 times the flame velocity.

The fume is heated in the tube, preferably by a burner which burns gas or the like. Above the burner the fume goes through a space where inspirated air is drawn in. The fume also may be aided by compressed air for burning in, and/or out of, the tube with increased oxygen content. This air is blown in below or about the burner.

In order to reduce the amount of heat required for the burner, the tube may be insulated.

DRAWINGS

In the drawings we have shown the prior art and also a preferred embodiment of the invention, without, however restricting it to the only possible such arrangement.

It will be evident that this is merely one suggested form.

DETAILED DESCRIPTION OF THE INVENTION

Figure 1:
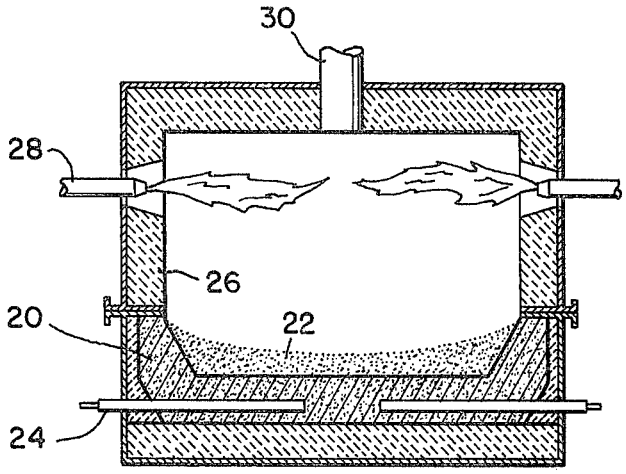
FIG. 1 is a diagrammatic cross section showing one form of electrolytic furnace which produces fume when its lining is being baked.
Figure 2:
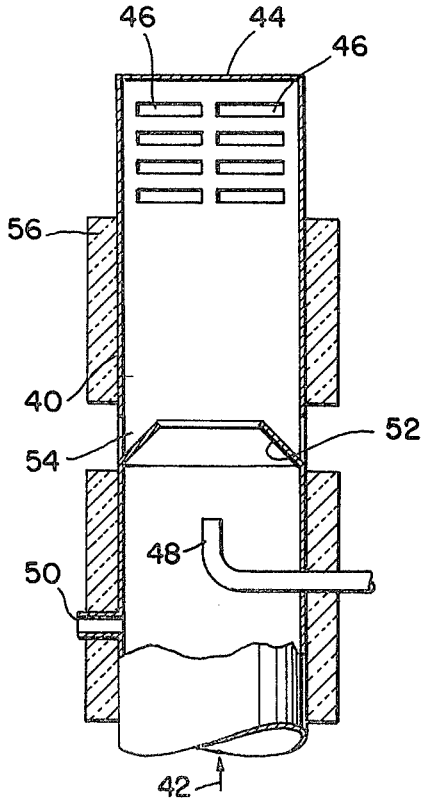
FIG. 2 is a diagrammatic section of a cylindrical fume flare of the present invention.

The invention as shown in FIG. 2 involves a vertical stack 40, suitably of 8 inches diameter steel tube, with the fume introduced in the bottom at 42, for example by attachment to stack 30 of FIG. 1. The fume progresses upwardly to a closed end 44 and radial slits 46 adjoining the closed end and preferably four in number. The slits extend around the tube for a suitable distance such as one-eighth of the circumference and have a width varying from one-eighth to one inch and preferably about five-eighths inch.

Around the slits is ambient air in which burning of the fume is completed.

The stack 40 is provided, adjacent the bottom, with a burner at 48 and to provide air for the burner and burning the fume it may optionally have an inlet for compressed air 50 adjacent the burner and preferably below it and, between the burner and the region of the slits, a slightly constricted space where a baffle 52 (venturi) is provided and inlet for inspirated air 54 is permitted, the inlet preferably being of about 1 inch in width and being above the inlet for compressed air.

In the showing of the invention, we preferably also include, as a part of stack 40, heat insulation 56 surrounding the steel tube.

EXAMPLE

The fume flare of the invention has a typical operating condition as follows:

With the compressed air turned off, the flow through one stack, which was mounted over a Hall-Heroult cell whose lining was being baked, as in a combination of FIGS. 1 and 2, was estimated to be

| | |
|---|---|
| Fume | 74 c.f. per hour |
| Methane for the burner | 106 c.f. per hour |
| Air inspirated in the burner | 1060 c.f. per hour |
| Air inspirated in the venturi | 384 c.f. per hour |
| | 1624 c.f. per hour standard conditions of temperature and pressure |

The venturi appears to promote turbulence for better heating of the fume.

Assuming the fume and the methane flame from the burner are at 1200° K, the velocity through the 6 inch diamater venturi is 7.7 feet per second. The velocity through the total slit area of 62.8 square inches is 4.54 feet per second.

This is about 3 times as high as the flame velocity and much of the fume burns outside the slits.

Complete combustion of the fume was estimated to require 7143 cubic feet of air per hour. At times fluctuations in the process would cause smoking, and this smoking was eliminated by the addition of up to about 1000 cubic feet per hour of compressed air through inlet 50.

Calculations follow:

The slit area at 8 inches diameter is as follows:

$$8 \text{ in. dia.} \times 3.14 \times \tfrac{5}{8} \text{ in} \times 4 \text{ slits} = 62.8 \text{ sq. in.}$$

The gas flow may be calculated as follows:

$$1000 \frac{\text{lbs. carbon mix}}{\text{cathode block}} \times 20 \text{ cathode blocks} \times$$

$$0.20 \frac{\text{lbs. pitch}}{\text{lbs. carbon mix}} \times 0.4 \frac{\text{lbs. loss}}{\text{lbs. pitch}} = 1600 \text{ lbs. fume.}$$

We may assume 2000 pounds of fume counting the amount of the carbonaceous seam mass tamped around the cathode blocks.

Assume average molecular weight of 200:

$$2000 \text{ lbs. fume} \times \frac{\text{lbs. mol.}}{200 \text{ lbs.}} \times 359 \frac{\text{c.f.}}{\text{lb. mol.}} \times$$

$$\frac{1}{5} \text{ hr. evolution} \times \frac{1}{10 \text{ stacks}} = \frac{71.8 \text{ c.f. fume}}{\text{hr. stack}}$$

The "lbs. mol." is the molecular weight in pounds.

The fume burners burn the following:

$$106{,}000 \frac{\text{btu}}{\text{hr.}} \times \frac{\text{c.f. methane}}{1000 \text{ btu}} = 106 \frac{\text{c.f. methane}}{\text{hr.}}$$

At 10:1 air ratio $$\frac{1060 \frac{\text{c.f. air}}{\text{hr.}}}{1166 \frac{\text{c.f. gas}}{\text{hr.}}}$$

at standard pressure and temperature.

Total gas flow through the venturi is 71.8 (c.f. fume/hr.) + 1166 (c.f./hr.) products of methane combustion = 1238 (c.f./hr.) at S.T.P. or approximately 1240 (c.f./hr.)

$$1240 \frac{\text{c.f.}}{\text{hr.}} \times \frac{1200° \text{ K}}{273° \text{ K}} = 5450 \frac{\text{c.f.}}{\text{hr.}} = 91 \frac{\text{c.f.}}{\text{min.}}$$

The velocity through the 6 inch diameter venturi vent at baffle 52 equals the following:

$$91 \frac{\text{c.f.}}{\text{min.}} \times \frac{1}{36 \text{ sq. in.} \times 0.785} \times \frac{144 \text{ sq. in.}}{\text{sq. ft.}} = 463 \frac{\text{ft.}}{\text{min.}} = 7.7 \frac{\text{ft.}}{\text{sec.}}$$

Inspirated air may be calculated as follows:

$$\frac{\text{c.f.}}{\text{min.}} = 1096.5 \times C_D A_3 \phi_i \sqrt{\frac{SP_1 - SP_3}{\delta}}$$

This is Equation No. 120 from p. 88 of Fan Engineering, 6th Ed., the Buffalo Forge Company, Buffalo, New York, where $C_D$ = coefficient of discharge having to do with contraction of the gas as it goes from one side to the other of the venturi.

$A_3$ = smallest cross sectional area of the venturi.

$SP_1$-$SP_3$ = static pressure upstream and downstream of the venturi.

$\phi_i$ = flow coefficient from Table 33 of Fan Engineering.

$\delta$ = gas density in pounds per cubic foot.

$$91 \frac{\text{c.f.}}{\text{min.}} = 1096.5 \times 0.98 \times \frac{36 \times 0.785}{144} \times 1 \sqrt{\frac{SP_1 - SP_3}{\delta}} =$$

$$211 \sqrt{\frac{SP_1 - SP_3}{\delta}}$$

$$\sqrt{\frac{SP_1 - SP_3}{0.02}} = 0.43$$

$$\frac{SP_1 - SP_3}{0.02} = 0.185$$

$$SP_1 - SP_3 = 0.0037 \text{ inches water gage}$$

$$SP_1 - SP_3 = 0.0037 \text{ inches water gage}$$

$$\frac{0.0037}{1} = \frac{x}{4005};$$

$$x = 14.8 \text{ ft./min.}$$

$$14.8 \frac{\text{ft.}}{\text{min.}} \times \frac{62.8 \text{ sq. in. c.f.}}{144 \text{ sq. in.}} = 6.4 \frac{\text{c.f.}}{\text{min.}} = 384 \frac{\text{c.f.}}{\text{hr.}}$$

The velocity through the slits is calculated as follows:

Add the 1240 (c.f. gas/hr.), from above, to the 384 (c.f./hr.) inspirated air to give 1624 (c.f./hr.) Then, $$1624 \frac{\text{c.f.}}{\text{hr.}} \times \frac{1200°K}{273°K} \times \frac{1 \text{ hr.}}{60 \text{ min.}} = 119 \frac{\text{c.f.}}{\text{min.}}$$

$$119 \frac{\text{c.f.}}{\text{min.}} \times \frac{1}{62.8 \text{ in.}^2} \times \frac{144 \text{ in.}^2}{1 \text{ ft.}^2} = 272 \frac{\text{ft.}}{\text{min.}} = 4.54 \text{ ft./sec.}$$

Flame velocity is about 1.5 feet per second for methane.

Amount of air needed for complete combustion of the 71.8 (c.f. fume/hr.):

$$40 \frac{\text{lbs. fume}}{\text{hr.}} \times \frac{150 \text{ lbs. air}}{12 \text{ lbs.fume}} \times \frac{\text{c.f.}}{0.07 \text{ lbs. air}} = 7143 \frac{\text{c.f. air}}{\text{hr.}}$$

Exemplary for introducing compressed air through inlet 50 is flow through a ¼-inch diameter orifice at 40 inches pressure water gage as in the above Table 26:

$$25{,}330 \frac{\text{ft.}}{\text{min.}} \times \frac{0.25 \times 0.25 \times 0.785 \text{ sq. ft.}}{144 \text{ sq.in.}} = 8.6 \frac{\text{c.f.}}{\text{min.}} = 518 \frac{\text{c.f.}}{\text{hr.}}$$

Ignition temperature and flame velocity which appear in the specification and claims is described by Reinhardt Schumann, Jr. in Vol. I of Metallurgical Engineering, pp. 98–101 (Engineering Principles) Addison-Wesley Press, Inc. 1952.

The form shown is not the exclusive form of the invention but is merely suggestive of the invention.

In view of our invention and disclosure, variations and modifications to meet individual whim or particular need will doubtless become evident to others skilled in the art to obtain all or part of the benefits of our invention without copying the method and device shown, and we, therefore, claim all such insofar as they fall within the reasonable spirit and scope of our claims.

Having thus described our invention what we claim as new and desire to secure by Letters Patent is:

1. A method of burning fume, including combustible gases and gas-borne combustible particles, comprising moving the fume in a tube through at least one slit in the tube, while preventing the fume from going further in the tube and while the fume is at least partially at ignition temperature, heating the fume in the tube by a burner, adding air between any slits and the burner, and moving the fume out into the air, the slit width and total area being chosen such that the fume velocity through any slits is between flame velocity and the flame blow-out velocity and such that the fume will burn before being quenched by the air to below ignition temperature.

2. A method of burning fume, including combustible gases and gas-borne combustible particles, comprising moving the fume in a tube through at least one slit in the tube, while preventing the fume from going further in the tube and while the fume is at least partially at ignition temperature, introducing in the tube compressed air for burning the fume, to increase the oxygen content, and moving the fume out into the air, the slit width and total area being chosen such that the fume velocity through any slits is between flame velocity and the flame blow-out velocity and such that the fume will burn before being quenched by the air to below ignition temperature.

3. A fume flare for burning fume, including combustible gases and gas-borne combustible particles, comprising a tube having a closed end and a slitted region at the closed end, the slits being of a width between one-eighth and 1 inch, and burner means in the tube for elevating the temperature of the fume in the tube.

4. A fume flare of claim 3, in which the slits are approximately five-eighths inch in width.

5. The invention of claim 3, in which the tube has an inspirator between the burner and the slit region.

6. The invention of claim 3, in which the tube has a compressed air source at about the burner.

7. The invention of claim 3, in which the tube is insulated.

* * * * *